United States Patent [19]

Minks

[11] Patent Number: 4,554,520

[45] Date of Patent: Nov. 19, 1985

[54] ELECTROMAGNETIC MINIATURE RELAY

[75] Inventor: Werner Minks, Heroldsberg-Kleingeschaidt, Fed. Rep. of Germany

[73] Assignee: International Standard Electric Corporation, New York, N.Y.

[21] Appl. No.: 541,524

[22] Filed: Oct. 13, 1983

[30] Foreign Application Priority Data

Oct. 15, 1982 [DE] Fed. Rep. of Germany ..... 3238223

[51] Int. Cl.[4] ..... H01H 9/02

[52] U.S. Cl. ..... 335/106; 335/128; 335/133; 200/283

[58] Field of Search ..... 335/83, 106, 128, 133, 335/196; 200/283, 1 A, 1 TK

[56] References Cited

U.S. PATENT DOCUMENTS

| | | | |
|---|---|---|---|
| 2,282,687 | 5/1942 | Vigren et al. | 200/283 |
| 2,632,065 | 3/1953 | Smith et al. | 200/283 |
| 4,364,018 | 12/1982 | Dammert et al. | 335/106 |

FOREIGN PATENT DOCUMENTS

| | | | |
|---|---|---|---|
| 574400 | 4/1959 | Canada | 335/133 |

*Primary Examiner*—John C. Martin
*Assistant Examiner*—George Andrews
*Attorney, Agent, or Firm*—James B. Raden; William J. Michals

[57] ABSTRACT

In a compact electromagnetic miniature relay comprising a contact spring (12) which is firmly clamped at one end, and which bears double contacts (9, 10) arranged on each side, and with the connecting line thereof extending vertically in relation to the longitudinal axis of the contact spring, and which are capable of being moved by an actuator (6) arranged on the armature (5), from stationary break contacts (7) to stationary make contacts (8), with said contact spring (12) being divided by a longitudinal slot (16) partly into two parallel spring legs (19, 20) pretensioned against the break contacts (7), and in which the actuator (6) engages between the clamping point (13) and the free end (11) of the contact spring, the actuator (6), according to the invention, is designed to have at least the same width as the contact spring (12) at the actuating point (17), with the longitudinal slot (16) beginning at a small spacing from the actuating point (17) and extending up to the end (11) of the contact spring (12), thus forming two spring legs (19, 20) which are capable of being moved independently of one another and which bear the pairs of switching contacts (9, 10), and within the area between the actuating point (17) and the clamping point (13), the cross section of the contact spring (12) is reduced to such an extent that it can be twisted more easily. Consequently, a "cross-contacting" of the double contacts is avoided and a service life of a relay can be prolonged.

5 Claims, 4 Drawing Figures

ELECTROMAGNETIC MINIATURE RELAY

The present invention relates to an electromagnetic miniature relay of the type as set forth in the preamble of claim 1.

Such a relay has become known from the German Utility Model DE-GM No. 78 20 553. Relays of this type have a very restricted mounting space. Therefore, the switching paths between the contacts are reduced to a minimum. It is desirable to have very soft spring characteristics for the contact springs. This is accomplished, for example, by using the longitudinally slotted contact springs. Such types of relays are manufactured in such a way that the coil set with the magnet system is assembled separately from the contact system. Small part dimensions necessitate precision in putting the system together and high demands are placed on manufacturing tolerances. Still, it may happen that the contact spring system may be misaligned with the magnet system longitudinal axis. This causes a reduction of the service life due to asymmetrical wear of the parts which are in operative connection with one another, wrong switching due to cross-contacting, which means that one make contact may already be closed while the other one of the parallel spring legs has not yet been lifted off the break contact.

It is the object of the present invention to overcome these dificiencies and to permit manufacturing of a relay with greater precision, fewer rejects, and a longer service life.

According to the invention, this object is achieved by the features set forth in the main claim. Due to the use of an actuator extending across the entire width of the contact spring combined with a cross-sectional reduction of the spring body in a particular area between the actuating point or line and the clamping point, the spring legs can be lifted asynchronously from the actuator contact edge, i.e. the contact spring legs can be misaligned relative to the actuator and each other. During the lifting, the contact spring is being somewhat twisted in its cross-sectionally reduced area, thus reducing an angle of the tilt, so that a "cross-contacting" is avoided. Moreover, actuator wear is reduced at the actuating point. Also, the web or the spring body between the cross-sectionally reduced area and a closed end of a slot separating the spring legs will be worn out more evenly so as to facilitate prevention of the step-like erosion in co-acting parts.

DE-AS No. 24 49 457 disclosed a flat spring having a double contact for use with a relay, in which a web is provided within the area of the actuating point. In that case, however, the actuator is of a pin-shaped design, making the invention object of reducing a tilt angle unachievable. This printed publication is addressed to quite a different problem.

Also, DE-AS No. 22 18 495 discloses a relay having a contact spring with a double contact, so as to let the longitudinal slot extend up to the end of the contact spring. In that case, however, the contact spring is actuated at the end of the spring legs in order to avoid the problem of tilting and "cross contacting".

Further advantageous details of the invention will now be described hereinafter with reference to an example of embodiment shown in FIGS. 1 to 4 of the accompanying drawings, in which.

Figure 1:
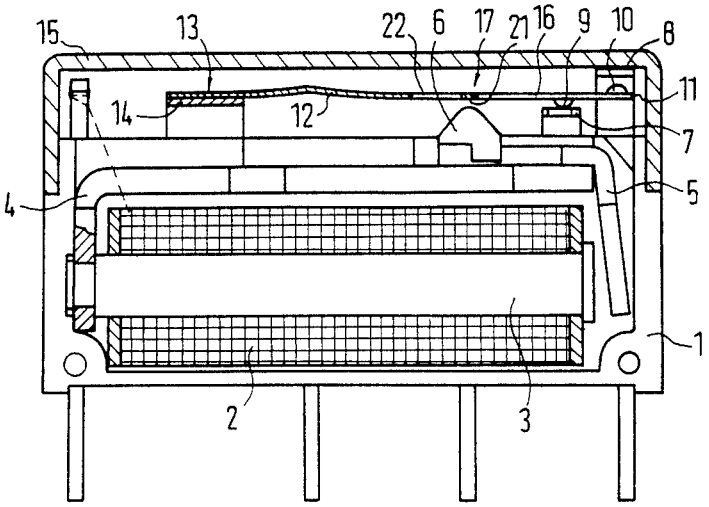
FIG. 1 is a side view of a relay according to the invention with a contact spring being cut along its longitudinal center line.
Figure 2:
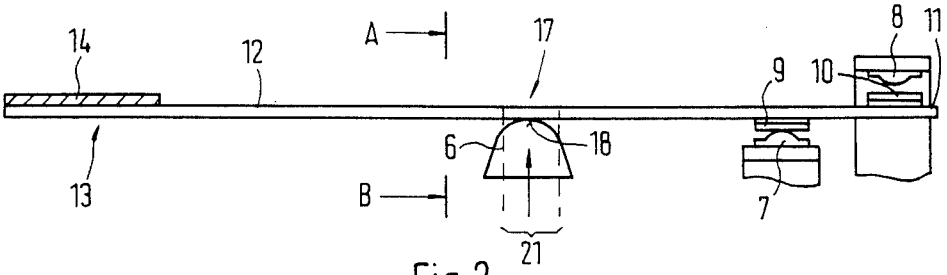
FIG. 2 is a side view of the contact spring.

In the drawings, the reference numeral 1 indicates a lower part of the housing of a relay in which a coil 2 with a core 3 is located. The core 3 of the coil 2 and a bracket 4 which is made out of soft-magnetic material form a magnet yoke. The magnetic circuit is closed by a tilting armature 5. The latter is provided with an actuator 6.

Above the magnet yoke there is arranged a contact system which consists of at least one stationary break contact 7, one stationary make contact 8 and the double contacts 9, 10 which are provided in pairs. These double contacts are located on the opposite sides of bifurcated end 11 of the tapered contact spring 12. A fixed end of the spring 12 is clamped at a clamping point 13 or is welded, for example, to a metal support 14, or secured in any other suitable manner. The relay is coverable by the housing 15.

According to the invention, the contact spring 12 is provided with a longitudinal slot 16 extending from the bifurcated end 11 to a point preceding the contact actuating point or line 17. The line 17 is formed by an apex or upper edge 18 of the actuator 6 for co-acting with the contact spring 12. The slot 16 divides the projecting portion of the contact spring into two independently moveable parallel spring legs 19 and 20, each of which having one lower contact 9 and one upper contact 10 on the opposite sides thereof.

Figure 3:
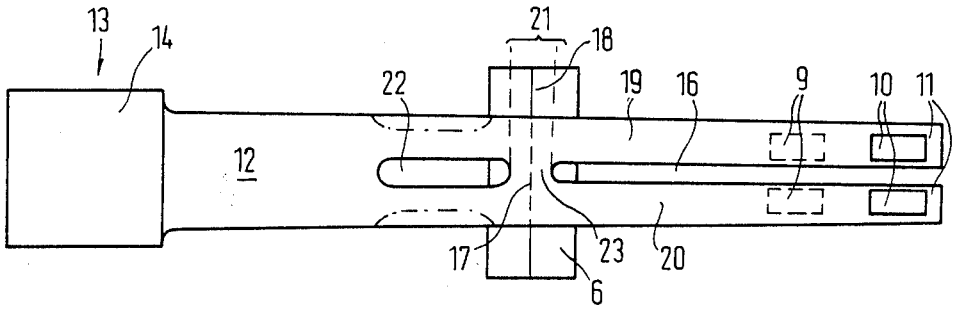
FIG. 3 is a top view of the contact spring.

The contact actuating line 17 and the actuator 6 extend across the full width of the spring 12 at a place where the spring cross-section is complete, namely, cross section of the contact spring 12 within the area 21 of the actuator 6. The cross section of the contact spring 12 is reduced between the area 21 and the clamping point 13, for example, by an additional longitudinal slot 22, so that the contact spring can be more easily twisted within this area. The slot 22 also imparts the spring with softer spring characteristics. The center longitudinal slot 22 can be substituted by one or more spring edge recesses, as indicated by the phantom lines in FIG. 3, thereby reducing a cross-sectional area of the spring 12.

Figure 4:
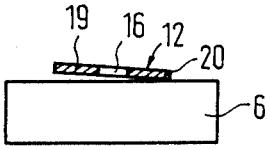
FIG. 4 is a schematic and partially cross-sectional view of the tilted contact spring.

As can be seen in FIG. 4, the contact spring 12 can be twisted or tilted with respect to the actuator 6. Upon lifting of the contact spring 12 when the relay is energized, both spring legs 19 and 20 may be lifted simultaneously. Although it may still happen that one contact 9 or 10 is lifted off earlier than the other, the "cross-contacting" is still avoided. Also, two contact springs can be located next to each other inside the relay, and for each of them there may be provided either a separate actuator 6 or one common actuator 6.

The full cross-section of the contact spring 12 may not necessarily lie within the area 21. In fact, the effect of the invention is also achievable when this full cross section, which practically forms a web 23 between the spring legs 19 and 20, is shifted from the actuating line 17 either more towards the end 11 or towards the clamping point 13.

I claim:

1. Electromagnetic miniature compact relay comprising: a contact spring firmly clamped at one end; and said contact spring having a bifurcated end including a pair of legs separated by a longitudinal slot;

each of said legs carrying one upper contact body and one lower contact body symmetrically opposing identical bodies mounted on another leg;

said contact spring including a cross-sectionally weakened area abutting a web spanning a hiatus between said slot and said weakened area;

an armature actuator extending across an entire width of said contact spring;

a line of contact between said contact spring and said actuator being disposed between said weakened area and closed end of said slot;

said legs being capable of moving independently of each other and said bifurcated end being twistable within said weakened area.

2. A relay as claimed in claim 1, and said twisting of said bifurcated end preventing undesirable diagonal contacts related to asynchronous movement of said legs.

3. A relay as claimed in claim 1, and said weakened area comprising a center slot located between said clamped one end and said line of contact.

4. A relay as claimed in claim 1, and said weakened area comprising a part of symmetrically opposed recesses in longitudinal edges of said contact spring.

5. Electromagnetic miniature compact relay comprising: a contact spring firmly clamped at one end;

said contact spring having a bifurcated end including a pair of legs separated by a longitudinal slot;

each of said legs carrying one upper contact body and one lower contact body symmetrically opposing identical bodies mounted on another leg;

said contact spring including a cross-sectionally weakened area abutting a web spanning a hiatus between said slot and said weakened area;

an armature actuator extending across an entire width of said contact spring;

a line of contact between said contact spring and said actuator being disposed between said weakened area and closed end of said slot;

said legs capable of moving independently of each other and said bifurcated end twistable about said weakened area;

said twisting of said bifurcated end facilitating contact of said contact bodies only with predetermined relay elements and preventing undesirable contacts related to asynchronous movement of said legs;

said weakened area comprising a center slot located between said clamped one end and said line of contact; and said weakened area comprising a pair of symmetrically opposed recesses in longitudinal edges of said contact spring.

* * * * *